US009373895B1

(12) United States Patent
Langfield et al.

(10) Patent No.: US 9,373,895 B1
(45) **Date of Patent: *Jun. 21, 2016**

(54) CONFORMAL WIDE BAND SURFACE WAVE RADIATING ELEMENT

(71) Applicant: Ball Aerospace & Technologies Corp., Boulder, CO (US)

(72) Inventors: John Langfield, Westminster, CO (US); John T. Mehr, Superior, CO (US); Daniel J. Carlson, Broomfield, CO (US)

(73) Assignee: BALL AEROSPACE & TECHNOLOGIES CORP., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/254,486

(22) Filed: Apr. 16, 2014

Related U.S. Application Data

(63) Continuation of application No. 12/536,343, filed on Aug. 5, 2009, now Pat. No. 8,736,502.

(60) Provisional application No. 61/087,437, filed on Aug. 8, 2008.

(51) Int. Cl.
*H01Q 1/42* (2006.01)
*H01Q 19/06* (2006.01)

(52) U.S. Cl.
CPC ..... *H01Q 19/062* (2013.01)

(58) Field of Classification Search
CPC ..... H01Q 19/06; H01Q 15/0013
USPC ..... 343/753, 776, 778, 780, 783, 784, 786, 343/789, 909
See application file for complete search history.

(56) References Cited

U.S. PATENT DOCUMENTS

| | | | | |
|---|---|---|---|---|
| 2,822,542 | A * | 2/1958 | Butterfield | H01Q 1/286 343/705 |
| 4,353,074 | A * | 10/1982 | Monser et al. | 343/786 |
| 5,389,937 | A * | 2/1995 | Kaloi | H01Q 19/005 343/700 MS |
| 7,612,718 | B2 * | 11/2009 | Sievenpiper | 343/700 MS |
| 7,629,937 | B2 * | 12/2009 | Lier et al. | 343/786 |

* cited by examiner

*Primary Examiner* — Dameon E Levi
*Assistant Examiner* — Hasan Islam
(74) *Attorney, Agent, or Firm* — Sheridan Ross P.C.

(57) ABSTRACT

Conformal antennas and methods for radiating radio frequency energy using conformal antennas are provided. In particular, one or more tapered feeds can be provided as part of or interconnected to a conductive top plate. The one or more tapered feeds have a depth that decreases from a feed point to a tip. The tip of the one or more tapered feeds is adjacent a cavity formed over a lens region. An aperture over the lens region can be covered or filled by an impedance surface. This impedance surface may comprise a frequency selective surface. Alternatively, a frequency selective surface can be provided over the lens region of an antenna incorporating one or more stripline feeds.

20 Claims, 7 Drawing Sheets

CONFORMAL WIDE BAND SURFACE WAVE RADIATING ELEMENT

CROSS-REFERENCE TO RELATED APPLICATIONS

This application is a continuation of U.S. patent application Ser. No. 12/536,343, filed Aug. 5, 2009, which claims the benefit of U.S. Provisional Patent Application Ser. No. 61/087,437, filed Aug. 8, 2008, the entire disclosures of which are hereby incorporated herein by reference.

FIELD

The present invention is directed to an antenna that produces endfire patterns over a wide instantaneous bandwidth conformally mounted into a conducting ground plane.

BACKGROUND

In designing antenna structures, it is desirable to provide appropriate gain, bandwidth, beamwidth, sidelobe level, radiation efficiency, aperture efficiency, EMI control, radiation resistance and other electrical characteristics. It is also desirable for these structures to be lightweight, simple in design, inexpensive and unobtrusive, since an antenna is often required to be mounted upon or secured to a supporting structure or vehicle, such as a cylindrical test body. It is also sometimes desirable to hide the antenna structure so that its presence is not readily apparent for aesthetic and/or security purposes. Accordingly, it is desirable that an antenna be physically small in volume and not protrude on the external side of a mounting surface while yet still exhibiting all the requisite electrical characteristics.

One type of antenna that has been successfully used for broadband conformal applications is the Doorstop™ antenna. The Doorstop™ antenna belongs to a class of antennas known as traveling wave antennas. Examples of other traveling wave antennas are polyrod, helix, long-wires, Yagi-Uda, log-periodic, slots and holes in waveguides, and horns. Antennas of this type have very nearly uniform current and voltage amplitude along their length. This characteristic is achieved by carefully transitioning from the element feed and properly terminating the antenna structure so that reflections are minimized.

A Doorstop™ antenna generally comprises a feed placed over a dielectric wedge, a groundplane supporting or adjacent to the dielectric wedge, and a cover or radome. The Doorstop™ antenna has two principal regions of radiation that affect patterns: the feed region and the lens region. The size and shape of these two regions generally control bandwidth and pattern performance.

In a typical Doorstop™ antenna, the measured voltage standing wave ratio (VSWR) improves with increasing frequency. At reduced frequencies the Doorstop™ element is electrically too short and functions more like a bent monopole antenna. The low frequency limit for the Doorstop™ element is set by the electrical depth of the element. More particularly, the maximum wedge depth and wedge dielectric constant determine the lowest frequency of operation. Once the physical depth and dielectric constant of the wedge are established, the lens to feed length ratio of the basic Doorstop™ configuration determines the pattern performance. At low frequencies, the pattern tends to look very uniform and nearly omnidirectional, while at high frequencies the pattern becomes quite directional or end-fired. Additionally, at high frequencies the pattern develops a characteristic null at the zenith that moves forward toward the horizon as the frequency increases. For certain applications and greater operating bandwidths, this characteristic pattern performance is undesirable.

Within about a 3 to 1 operating bandwidth, the pattern characteristic can be controlled by adjusting the lens to feed length ratio of the antenna. As the frequency increases above the 3 to 1 ratio, the lens becomes electrically long, producing field components that either support or interfere with the radiation from the feed region. This leads to the creation of nulls in the forward portion of the farfield elevation plane pattern.

Other aspects of the typical Doorstop™ antenna that degrade performance include the use of an unsupported (not grounded) micro-stripline near the coax feed, which adversely affects the element impedance match. Also, the coaxial pin typically used to interconnect the feed to a transmission line and the micro-stripline are sources of radiation, that can degrade pattern performance by creating pattern nulls at certain angles. In addition, trapped energy in the dielectric wedge results in large impedance variation at low frequencies. As still another disadvantageous feature, because the element feed of a typical Doorstop™ antenna is on the surface of the device, it is exposed to improper handling and high temperatures that cause variation in radio-frequency (RF) performance.

SUMMARY

Embodiments of the present invention are directed to solving these and other problems and disadvantages of the prior art. In accordance with embodiments of the present invention, a traveling wave antenna element with wide band frequency characteristics is provided. The antenna includes a tapered feed that extends into or towards a cavity associated with a lens region. In accordance with other embodiments of the present invention, the antenna incorporates multiple feeds. More particularly, multiple tapered feeds may be provided. The multiple tapered feeds are associated with a cavity opposite a lens region. Where multiple feeds are included, the feeds may be spaced apart from one another.

In accordance with further embodiments, the antenna element may feature a lens region with a frequency selective surface that overlays the lens region. The frequency selective surface may incorporate an impedance taper. The volume between the frequency selective surface, the tapered feed and a ground plane that includes shaping to form at least a portion of the lens region and cavity may be filled with a dielectric material. A frequency selective surface overlay may be used in combination with a tapered feed or feeds, or with a conventional stripline feed or feeds. In addition, a radio frequency absorbing material may be placed at an end of the antenna element opposite the lens region.

Additional features and advantages of the present invention will become more readily apparent from the following description, particularly when taken together with the accompanying drawings.

DETAILED DESCRIPTION

Embodiments of the present invention provide an antenna element that produces endfire patterns over a wide instantaneous bandwidth when conformally mounted into a conducting ground plane. The antenna can be dielectrically loaded to improve endfire directivity and to lower its operational bandwidth. The antenna can be used as a single element or in an array having a plurality of elements, and its compact design can radiate at lower frequencies than comparable antennas. Moreover, the antenna is capable of providing efficient broadband endfire radiation with a constant pattern. The antenna element can include a broadband internal feed integrated into a low profile radiating structure, a reactive surface sandwich with a loss mechanism for elevation pattern lobing control, and stable radiation patterns over a wide frequency band. These features can be provided such that radiation efficiency and pattern coverage is maximized, while maintaining conformal attributes.

Figure 1:
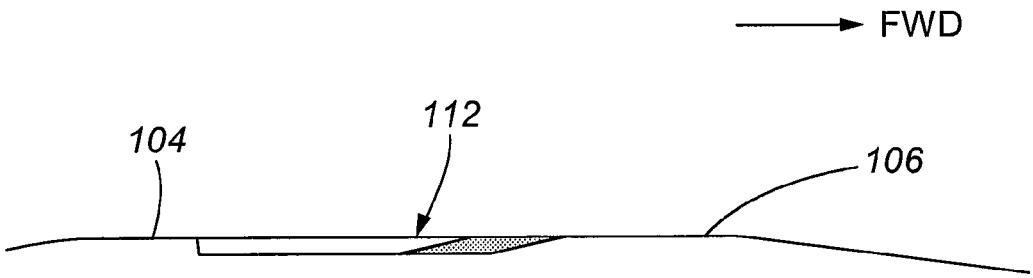
FIG. 1 depicts a surface of a vehicle incorporating an antenna element, shown in cross section, in accordance with embodiments of the present invention.

FIG. 1 illustrates a partial cross section of an area of a vehicle 104, that incorporates an antenna 108 comprising an antenna element 112 in accordance with embodiments of the present invention. As shown in FIG. 1, the antenna element 112 can be conformally mounted in or coincided with the surface 106 of a vehicle or body. Moreover, the vehicle or body surface 106 may comprise a conductive surface. In addition, embodiments of the present invention allow an antenna 108 comprising a system consisting of an array having a plurality of elements 112 to be provided. For example, a plurality of elements 112 can be spaced around a cylindrical test body.

Figure 2:
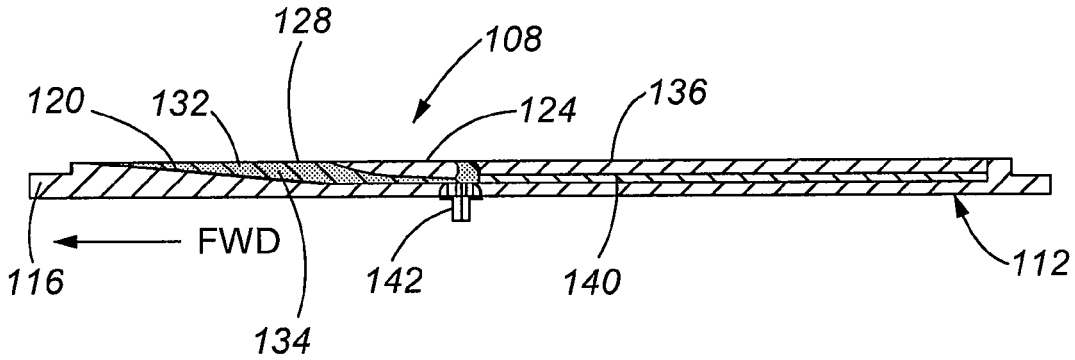
FIG. 2 is a cross section of an antenna element in accordance with embodiments of the present invention.

FIG. 2 is a cross section of an antenna element 112 in accordance with embodiments of the present invention. The antenna element 112 features a conductive ground plane 116, a lens region 120, and a tapered feed 124. As illustrated, the antenna element can also include a frequency selective surface 128 adjacent to and overlaying all or a portion of the lens region 120. In addition, the antenna element 112 can include a dielectric material 132 in a cavity 134 in and around the lens region 120, between the ground plane 116 and the tapered feed 124. The dielectric material 132 can fill all or substantially all (i.e., can fill more than half) the volume of the cavity 134. The tapered feed 124 may be connected to or formed as a part of a conductive top plate 136. The outer surface of the top plate 136 and the frequency selective surface 128 may combine to form a substantially continuous surface, for example that conforms to the surface of the vehicle 104. The antenna element 112 may also feature a radio frequency absorbing material 140 behind the tapered feed 124 (i.e., on a side of the tapered feed opposite the lens region 120). The radio frequency absorbing material 140 can be sandwiched between at least a portion of the top plate 136 and at least a portion of the ground plane 116. The dielectric material 132 and the radio frequency absorbing material 140 can selectively comprise an electromagnetic interference (EMI) absorbing material. A connector 142, such as a 50Ω radio frequency coaxial connector, may be provided for connecting the tapered feed 124 to a signal line, and for connecting the ground plane 116 to ground.

Figure 3:
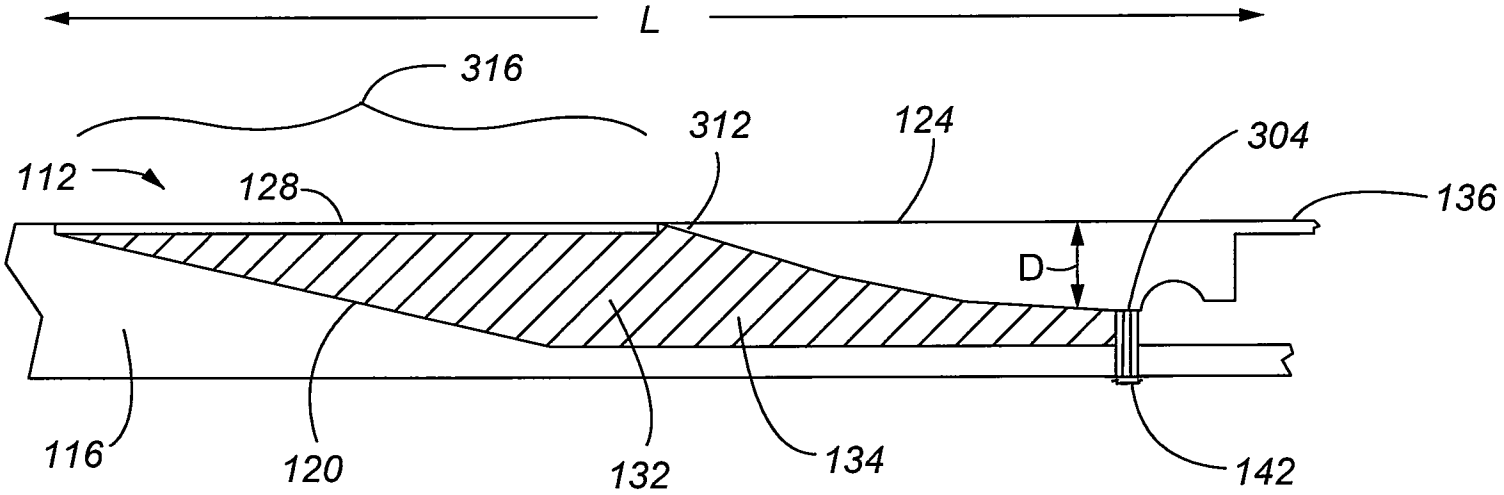
FIG. 3 is a cross section of the feed and the lens region of an antenna element in accordance with embodiments of the present invention.

FIG. 3 is a partial cross section of an antenna element 112, showing the lens region 120 and the tapered feed 124. As shown, the lens region 120 is formed as part of the ground plane 116. A frequency selective surface 128 can overlay the lens region 120 and at least a portion of the cavity 134, and generally extends between the end of the tapered feed 124 and the end of the lens region 120. The area occupied by the frequency selective surface 128 (or other impedance surface or radome if no frequency selective surface 128 is provided) generally corresponds to a radiating aperture 316 of the antenna element 312.

The tapered feed 124 includes a depth D that generally decreases along the length of the feed 124, from the feed input or feed point 304, where the feed 124 is connected to a signal line by, for example, a coaxial connector 142, to the tip 312. Accordingly, the feed 124 may be considered a tapered fin element feed 124. In accordance with further embodiments of the present invention, the depth D of the feed 124 may decrease exponentially from the feed point 304 to the tip 312. In accordance with still other embodiments of the present invention, the curve of the taper can be according to any selected function. In general, as the impedance of the tapered feed 124 transitions away from the impedance of the feed input or port 304, along the length of the tapered feed 124 from the feed point 304 to the tip 312, the electromagnetic energy begins to radiate into the dielectric material 132 in the cavity 134 in and around the lens region 120. At the tip 312 of the tapered feed 124, where the tapered feed 124 terminates into the top plate 136, the electromagnetic energy has all been transferred into the dielectric material. Once the E-field and the H-field have reached the lens region 120, the dielectric height or thickness of the dielectric material 132 is gradually tapered to radiate the energy into free space. The configuration of the antenna element 112 in accordance with embodiments of the present invention allows a stable endfire pattern to be maintained over the operating bandwidth of the antenna 108. The low frequency limit of the antenna 112 operating bandwidth is generally determined by the length of the cavity 134 defined by the lens region 120. The high frequency of the antenna 112 bandwidth is set by the frequency selective surface 128. In particular, as described in greater detail below, the frequency selective surface 128 may feature a tapered capacitance, such that the effective aperture of the lens region 120 is different for different transmitted (or received) frequencies. Accordingly, the antenna element 112 may be considered a controlled surface impedance radiating element. The inclusion of a reactive frequency selective surface 128 allows the antenna 108 to achieve stable elevation patterns, while avoiding pattern nulls.

Figure 4:
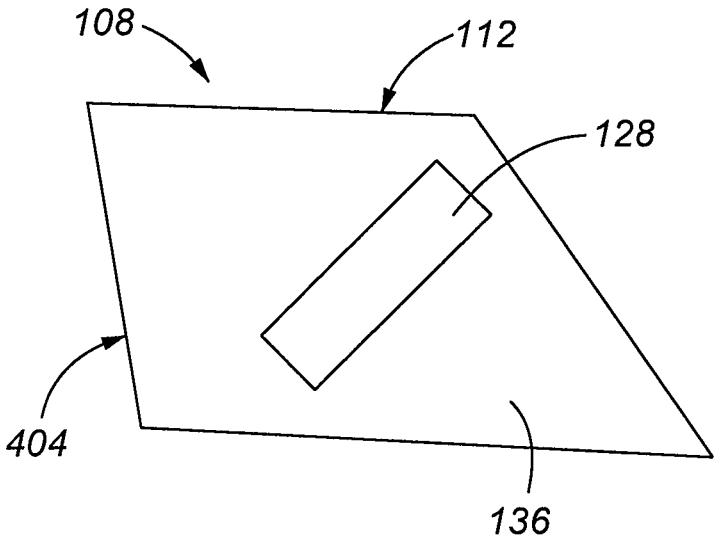
FIG. 4 is a top perspective view of an antenna array in accordance with embodiments of the present invention.

FIG. 4 is a perspective view of an antenna 108 comprising an antenna array 404 that includes a plurality of antenna elements 112 that each incorporate a tapered feed 124 (shown in FIGS. 5 and 6) in accordance with embodiments of the present invention. In the top perspective view of FIG. 4, the conductive top plate or surface 136 and the semi-conductive frequency selective surface 128 (which alternatively may comprise an impedance surface or radome) are visible.

Figure 5:
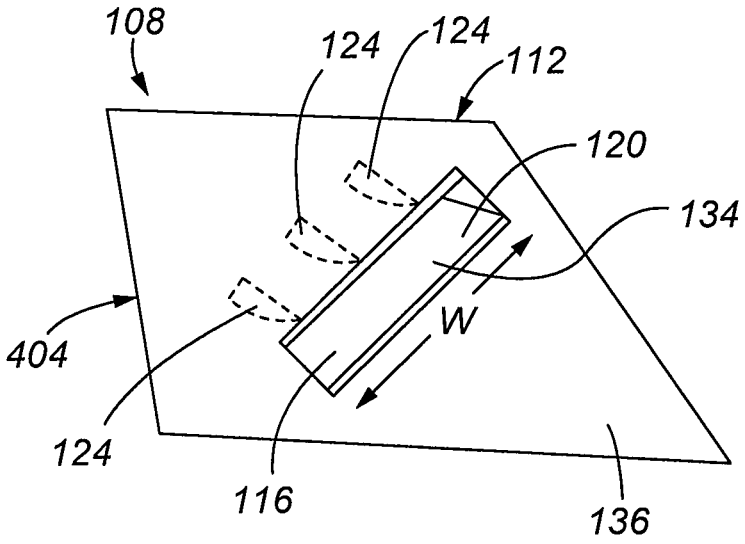
FIG. 5 is a top perspective view of the antenna array of FIG. 4, with the frequency selective surface removed.

In FIG. 5, the antenna array 404 of FIG. 4 is illustrated, with the frequency selective surface 128 removed. With the frequency selective surface 128 removed, the lens region 120 formed by the ground plane 116, and a portion of the cavity 134 is visible. In addition, the tapered feeds 124 of this exemplary array 404, which are formed on the bottom side of the top plate 136, are shown with dotted lines. The tapered feeds 124 may be formed as part of or integral to the top plate 136. Alternatively, the tapered feeds 124 may be fixed and electrically interconnected to the top plate 136. Although the example antenna 108 shown in FIG. 5 has three antenna elements 112, an antenna 108 in accordance with embodiments of the present invention may have n tapered feeds 124, where n is any number. Also, a frequency selective surface 128 is not required. In accordance with at least some embodiments of the disclosed invention, a radome may be provided in place of or in addition to a frequency selective surface 128. The radome may comprise an impedance surface.

Figure 6:
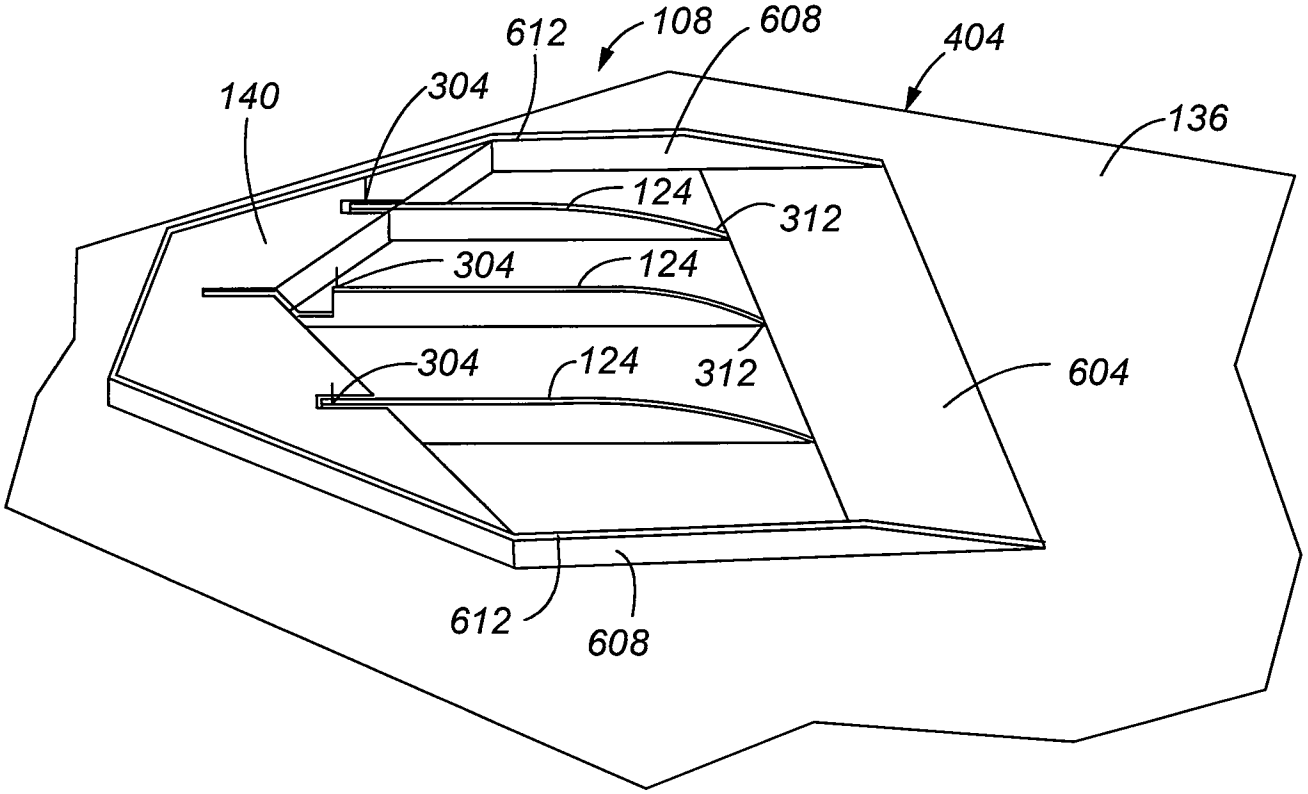
FIG. 6 is a partial bottom perspective view of the antenna array of FIG. 5, with the ground plane removed.

FIG. 6 is a bottom perspective view of the antenna array 404 depicted in FIGS. 4 and 5. Accordingly, FIG. 6 shows the underside of the top plate 136 of this embodiment. In this illustrated embodiment, the tapered feeds 124 are integral to the top plate 136. As shown, the tapered feeds 124 may be arranged such that they are substantially parallel to one another and such that they are substantially orthogonal to the outer surface of the top plate 136. In addition, it can be seen that the tip or endpoint 312 of each of the tapered feeds 124 is at or near the edge of an aperture 604 formed in the top plate 136 that coincides with at least a portion of the lens region 120. The aperture 604 receives and is covered by the frequency selective surface 128 (and/or a radome) when the antenna array 404 is fully assembled. The bottom of the top plate 136 of this embodiment features walls 608 that form a surface 612 to which the ground plane 116 can be mounted, for example using a dielectric adhesive. A radio frequency absorbing material 140 generally fills the volume defined by the walls 608 behind the tapered feeds 124. As shown in the figure, the radar absorbing material 140 can extend forward such that it encompasses at least some of one or more of the tapered feeds 124 proximate to the feed points 304. The remainder of the volume or cavity 134 defined by the walls 608, the ground plane 116 and the frequency selective surface 128, when the ground plane 116 and frequency selective surface 128 are attached to the top plate 136, may contain or be filled with a dielectric material 132 (e.g., as illustrated in FIG. 3). In accordance with further embodiments of the present invention, the dielectric material 132 can be formed from layers of material having different dielectric constants. Moreover, the dielectric material 132 or layers of dielectric material can comprise wedges or other shapes to conform to the boundaries of the cavity 134 and/or to influence the pattern of the beam formed by the antenna 108. In accordance with still other embodiments of the present invention, some or all of the cavity 134 can simply contain air.

As mentioned previously, the number and configuration of tapered feeds 124 can be varied. In general, the number of tapered feeds 124 and thus the number of antenna elements 112 included in an antenna 108 can be determined from the desired operating characteristics of the antenna 108. In addition, the number of antenna elements 112 included in an antenna 108 may be determined as a function of the desired physical characteristics of the antenna 108 for the particular application. For instance, where the antenna 108 will be incorporated into a substantially planar body surface 106, and where the lateral extent of the antenna 108 can be relatively large, a relatively large number of antenna elements 112 and tapered feeds 124 can be incorporated. As a further example, where the body surface 106 into which the antenna 108 is to be incorporated is contoured and/or where the width of the antenna 108 is otherwise constrained, the number of tapered feeds 124 can be relatively small. For example, the antenna 108 may comprise a single tapered feed 124. As another example, where the body surface 106 is contoured, a number of relatively narrow antenna elements 112 may be employed, creating a multifaceted surface. As yet another alternative, the antenna element 112 may be curved along the width of the antenna element 112, to conform to a curved body surface 106. In accordance with still other embodiments, the antenna element 112 may be curved along some or all of the length of the antenna element 112, again to conform to a contoured body surface 106.

Figure 7:
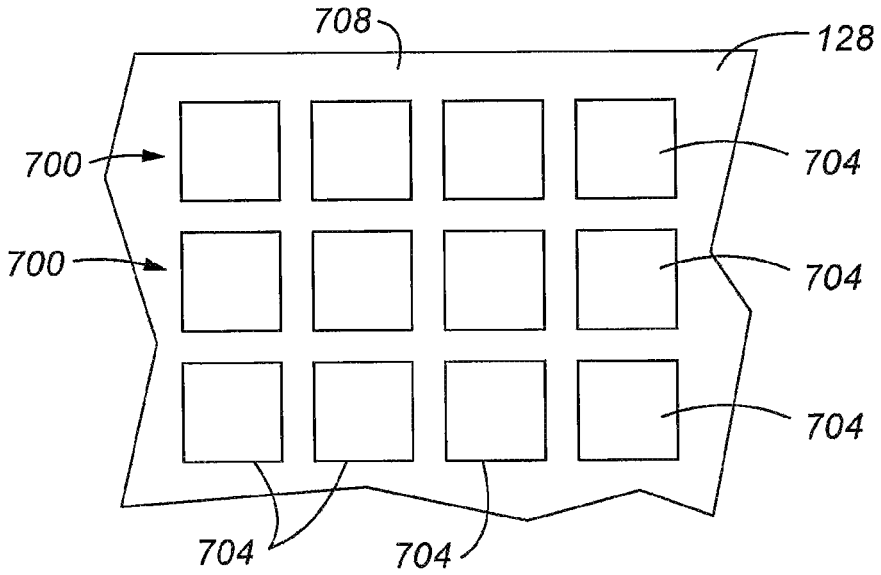
FIG. 7 is a partial plan view of a frequency selection surface in accordance with embodiments of the present invention.

FIG. 7 is a partial plan view of a frequency selective surface 128 in accordance with embodiments of the present invention. In general, the frequency selective surface 128 comprises rows 700 of capacitors 704 on a supporting dielectric layer 708. In accordance with embodiments of the present invention, the capacitance of the capacitors 704 formed at each row may vary. In accordance with embodiments of the present invention, the rows 700 are generally perpendicular to the tapered feed or feeds 124 when the frequency selective surface 128 is in place over the lens region.

Figure 8:
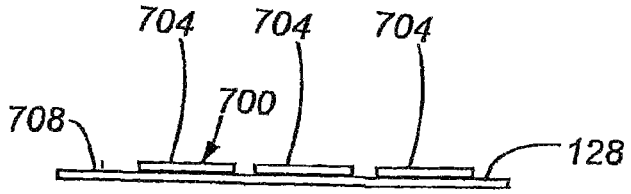
FIG. 8 is a partial cross section of a frequency selective surface in accordance with embodiments of the present invention.

FIG. 8 is a partial cross section of a frequency selective surface 128 in accordance with embodiments of the present invention. A variation in capacitance may be achieved by varying the area of the capacitors 704.

Figure 9:
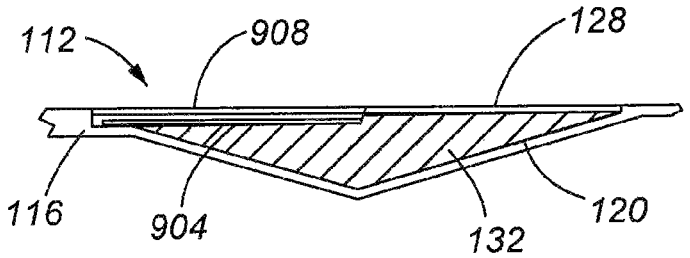
FIG. 9 is a cross-section of the feed and lens region of an antenna element in accordance with other embodiments of the present invention.

FIG. 9 illustrates an antenna element 112 in accordance with embodiments of the present invention that include a conventional stripline feed 904 (or multiple stripline feeds 904) and a frequency selective surface 128 overlaying the lens region 120. The frequency selective surface 128 may feature a tapered capacitance. Alternatively, the frequency selective surface 128 can provide a constant or relatively constant capacitance across the surface of the frequency selective surface 128. A radome 908 may overlay the feed or feeds 904.

Figure 10:
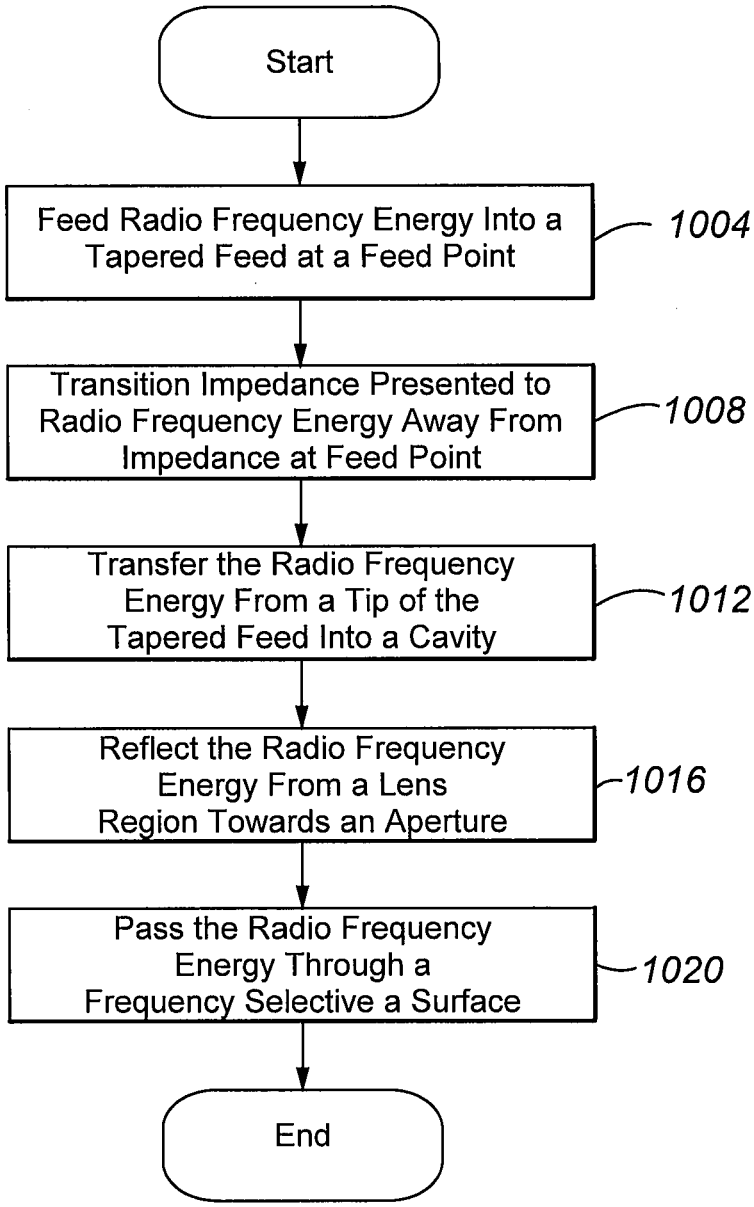
FIG. 10 is a flowchart illustrating aspects of a method for forming a radio frequency beam in accordance with embodiments of the present invention.

FIG. 10 is a flow chart illustrating aspects of a method for forming a radio frequency beam in accordance with embodiments of the present invention. Initially, radio frequency energy is fed into a tapered feed 124 at a feed point 304 (step 1004). The impedance presented to the radio frequency energy is transitioned away from the impedance at the feed point 304 as that energy is carried from the feed point 304 towards the tip 312 of the tapered feed 124 (step 1008). At step 1012, the radio frequency energy is transferred from or near the tip 312 of the tapered feed 124 into a cavity 134. The radio frequency energy is next reflected from a lens region 120 towards an aperture 604 formed in a conductive surface, such as a conductive top plate 136 (step 1016). The radio frequency energy is then passed through a frequency selective surface 128 as it exits the cavity 134 (step 1020). Although operation of the antenna 108 in accordance with embodiments of the present invention has been described in terms of the transmission of radio frequency energy, it can be appreciated by one of skill in the art that the antenna 108 and the method can additionally or alternatively operate to receive radio frequency energy.

Figure 11:
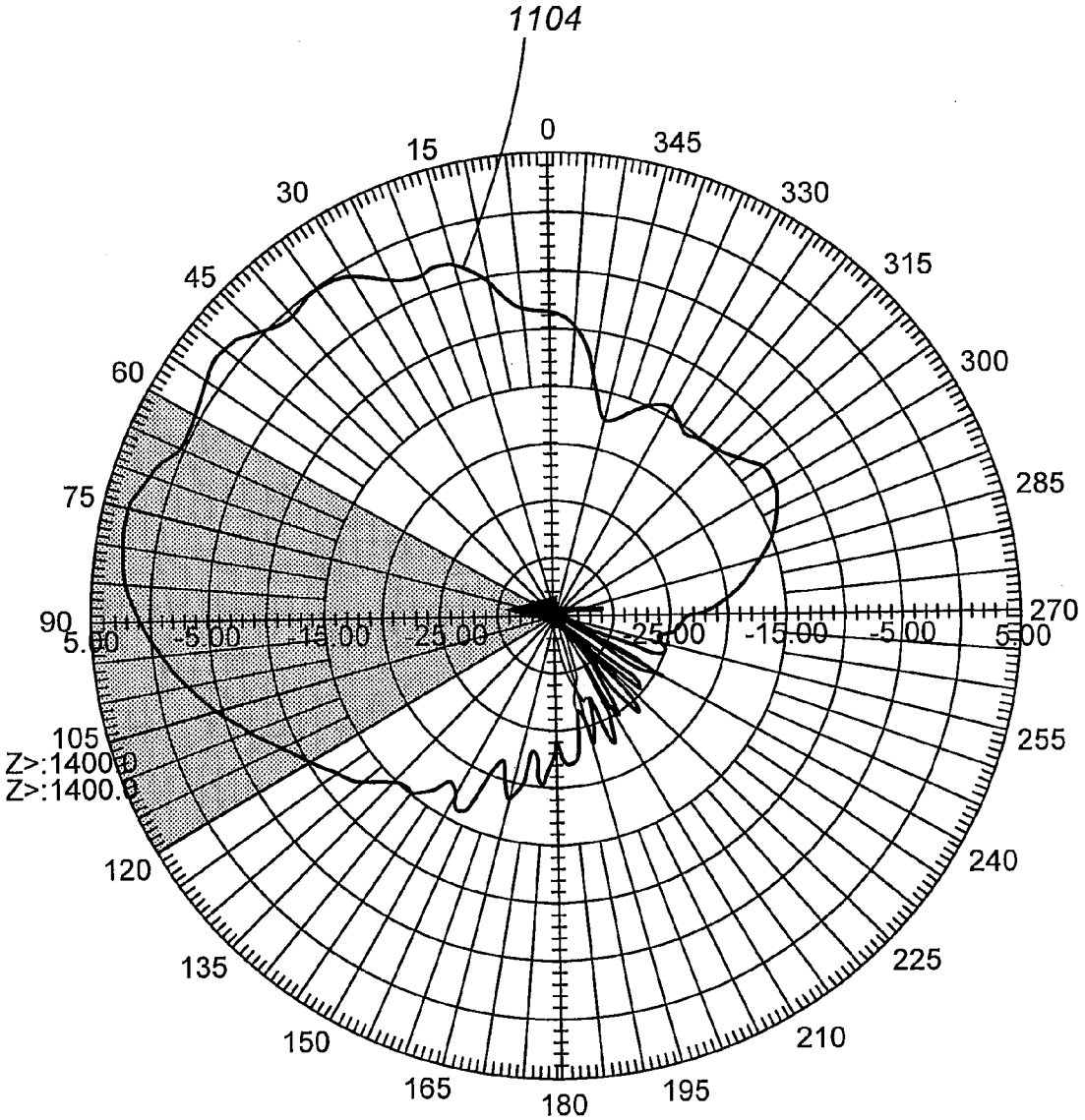
FIG. 11 depicts a beam pattern produced by an antenna element in accordance with embodiments of the present invention.

FIG. 11 depicts a beam pattern produced by an antenna element 108 in accordance with embodiments of the disclosed invention at a particular frequency. The arrow at the center of the graph indicates the forward direction. As shown, the pattern 1104 can be characterized as a stable endfire pattern that is stable in elevation and that is without significant nulls in a forward and upward direction relative to the antenna element 108.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna element, comprising:

a top plate;

at least one tapered feed, wherein the tapered feed extends from a surface of the top plate, wherein the tapered feed has a length dimension extending between a feed point and a tip, wherein the tapered feed has a depth dimension that extends in a direction perpendicular to the length dimension of the tapered feed, wherein a depth of the tapered feed decreases from the feed point to the tip such that a distance of an edge of the tapered feed from the surface of the top plate decreases from the feed point to the tip; and a ground plane forming a lens region, wherein the ground plane is interconnected to the top plate, wherein the lens region of the ground plane defines a surface of a cavity, wherein the cavity has a depth dimension that is parallel to the depth dimension of the tapered feed, and wherein the depth of the cavity decreases from a point adjacent the tip of the tapered feed to a point distal from the tip of the tapered feed.

2. The antenna element of claim 1, wherein the depth of the tapered feed decreases exponentially.

3. The antenna element of claim 1, further comprising:

a dielectric material, wherein the dielectric material substantially fills the cavity.

4. The antenna element of claim 1, wherein the tapered feed is interconnected to the top plate.

5. The antenna element of claim 4, wherein the tapered feed is integral to the top plate.

6. The antenna element of claim 4, wherein the top plate defines an aperture, and wherein the aperture is adjacent at least a portion of the lens region.

7. The antenna element of claim 6, further comprising:

a radome, wherein the radome covers the aperture.

8. The antenna element of claim 1, further comprising:

a frequency selective surface, wherein the frequency selective surface is adjacent the lens region.

9. The antenna element of claim 8, wherein the frequency selective surface has a variable capacitance that changes from a portion on a side of the lens region proximal to the tip of the tapered feed to a portion on a side of the lens region distal from the tip of the tapered feed.

10. The antenna element of claim 9, wherein the variable capacitance decreases linearly from the portion on the side of the lens region proximal to the tip of the tapered feed to the portion on the side of the lens region distal from the tip of the tapered feed.

11. An array antenna, comprising:

a top plate;

a plurality of tapered feeds formed as part of the top plate, wherein each tapered feed in the plurality of tapered feeds has a length extending between a feed point and a tip, wherein each of the tapered feeds has a depth, wherein the depth of each of the tapered feeds decreases from the feed point to the tip, wherein the length and depth of each of the tapered feeds are parallel to at least a first plane; and a ground plane forming a lens region, wherein the ground plane is interconnected to the top plate, wherein the lens region of the ground plane defines a surface of a cavity, wherein the cavity has a depth dimension that is parallel to the depth dimension of the tapered feeds, and wherein the depth of the cavity decreases from a point adjacent the tips of the tapered feeds to a pint distal from the ti of the to tapered feeds.

12. The array antenna of claim 11, further comprising:

an aperture, wherein the aperture is at least partially formed in the top plate, and wherein the aperture is adjacent at least a portion of the lens region.

13. The array antenna of claim 12, further comprising:

an impedance surface, wherein the impedance surface is received by the aperture.

14. The array antenna of claim 13, wherein the impedance surface is a frequency selective surface.

15. The array antenna of claim 14, wherein the frequency selective surface provides a tapered capacitance.

16. The array antenna of claim 11, wherein the cavity is substantially filled by a dielectric material.

17. The array antenna of claim 11, wherein the depth of the tapered feed of each antenna element decreases exponentially.

18. An antenna, comprising:

a top plate;

a tapered feed that extends from a surface of the top plate, wherein a distance of an edge of the tapered feed from the top plate changes along a length of the tapered feed, and wherein the to erect feed has at least a first surface that extends between the edge and the surface of the top plate that lies within a first plane;

a ground plane, wherein the ground plane is interconnected to the top plate, wherein the ground plane defines a lens region, wherein the lens region of the ground plane defines a cavity, wherein the cavity has a depth dimension that is parallel to the first plane, and wherein the depth of the cavity decreases from a point adjacent the tip of the tapered feed to a point distal from the tip of the tapered feed; and a frequency selective surface overlaying the lens region.

19. The antenna of claim 18, wherein the frequency selective surface provides a tapered capacitance.

20. The antenna of claim 18, wherein the antenna includes a plurality of tapered feeds that extend from the surface of the top plate and that are adjacent to one another.

* * * * *